United States Patent [19]

Foresman

[11] Patent Number: 4,553,496

[45] Date of Patent: Nov. 19, 1985

[54] QUICK RELEASE TILLER EXTENSION

[76] Inventor: Robert Foresman, 26902 Paceo Cardero, San Juan Capistrano, Calif. 92675

[21] Appl. No.: 568,786

[22] Filed: Jan. 6, 1984

[51] Int. Cl.[4] ..... B63H 25/06

[52] U.S. Cl. ..... 114/144 R; 74/480 B; 114/162; 403/327

[58] Field of Search ..... 114/144 R, 162, 221 R; 74/480 B, 544, 546; 403/326–330, 377; 16/115

[56] References Cited

U.S. PATENT DOCUMENTS

| | | | |
|---|---|---|---|
| 998,318 | 7/1911 | Young | 403/327 |
| 3,065,011 | 11/1962 | De Pew | 403/328 |
| 3,366,406 | 1/1968 | Morris | 403/327 |
| 3,886,962 | 6/1975 | Diamontis | 403/327 |
| 3,955,438 | 5/1976 | Zakrzewski | 74/544 |
| 4,262,619 | 4/1981 | Hine | 114/144 R |

*Primary Examiner*—Trygve M. Blix
*Assistant Examiner*—Stephen P. Avila
*Attorney, Agent, or Firm*—G. Donald Weber, Jr.

[57] ABSTRACT

This invention is directed to a tiller extension which is used on the tiller of boats or vessels, in particular. The tiller extension of this invention is directed to a quick release, remote release, telescoping extension device.

9 Claims, 4 Drawing Figures

23
22
60
20
21
19
29
16
13
12
11
10
30
17
15
18
3
3
50
52
51
41
40
42
A
C
B 101
100

QUICK RELEASE TILLER EXTENSION

BACKGROUND

1. Field of the Invention

This invention is directed to marine hardware, in general, and to tiller extension devices, in particular.

2. Prior Art

In the pursuit of sailing, for pleasure or the like, it is usually the case that a tiller is provided with the sailing vessel. The tiller is used by the sailor to steer, at least to some extent, the boat which is being sailed. The tiller can be located at any desired location relative to the sailboat but is typically in the stern or midship's regions. In order for the sailor to have access to the tiller, it is usually required that the sailor be disposed in the same general vicinity as the tiller, per se. However, this is somewhat limiting of the sailor's position and the subsequent operation of the sailboat. For example, in a small sailboat, a single sailor may also have to take care of the sails, manipulate sheets and the like. This is frequently done by maintaining one hand on the tiller and the other on an appropriate sheet or the like. In addition, the sailor frequently has to extend his body outboard of the boat (called "hiking"). This cannot easily be accomplished if the sailor must remain immediately adjacent to the tiller. Consequently, it has become the practice to use a device referred to as a tiller extension. In a tiller extension, a pole or rod is joined to the tiller plate so that the sailor can be somewhat removed from the precise location of the tiller and, thereby, accomplish other activities such as hiking or sail management.

After the initial application or utilization of a tiller extender, it became desirable to have the tiller extension adjustable to permit the sailor to have even more freedom of location. One of the premier tiller extension of this type is manufactured by Fores Manufacturing Corporation and comprises a telescoping tubular extension pole which includes a cam locking arrangement. Thus, the tiller extension can be extended to the desired length and, through the operation of the cam lock, locked at that length by the sailor. A twist of the knob at the end of the tiller extension unlocks the cam and permits the tiller extension to be further adjusted.

However, despite the high degree of accuracy and reliability of this type of tiller extension, some sailors prefer to have a visual indication of the locking of the telescoping pole. To this end, a telescoping pole with a button in an inner tube which button mates with apertures in an outer tube has been devised. In this case, the button is spring loaded and extends through a hole in the outer tube to lock the extended pole in position. In order to unlock and re-adjust the tiller extension, it is necessary to press the button and remove it from the hole wherein the tiller extension can be moved and relocated.

However, this type of device has a distinct disadvantage in that it requires two hands to manipulate. Thus, a sole or single sailor will encounter difficulties in attempting to adjust this tiller extension and, at the same time, manipulate and control the sails and/or rigging of the sailboat. Moreover, the sailor is required to change his position in order to reposition the tiller extension. That is, the tiller which has been positioned for a sailor in the hiking position, must now be readjusted if the sailor comes back inboard. This, of course, presents problems to the sailor in terms of the time and effort required to make these adjustments.

Consequently, modifications are desired.

SUMMARY OF THE INVENTION

This invention is directed to a telescoping tiller extension which includes an outer tube which is connected to the tiller, per se, via suitable hardware. This outer tube includes a plurality of holes along the length thereof and in a prescribed linear arrangement. The tiller extension also includes an inner tube which has a retractable, spring loaded button associated therewith. The button is adapted to selectively pass through the apertures in the outer tube to mate therewith and cause a locking arrangement. In addition, a linkage apparatus is provided within the inner tube whereby the spring loaded button can be removed from engagement with the holes in the outer tube, by means of the linkage, and from the extreme end of the telescoping tiller extension.

The extreme end of the tiller extension includes a handle apparatus by which the sailor holds the tiller extension. The linkage is arranged to have an operating mechanism adjacent to this handle for easy access by the operator.

BRIEF DESCRIPTION OF THE DRAWINGS

FIGS. 2A, 2B and 2C are diagrams showing the general configuration of the spring loaded button apparatus used in the instant invention.

DESCRIPTION OF THE PREFERRED EMBODIMENT

Figures 1, 2, 3, 4:
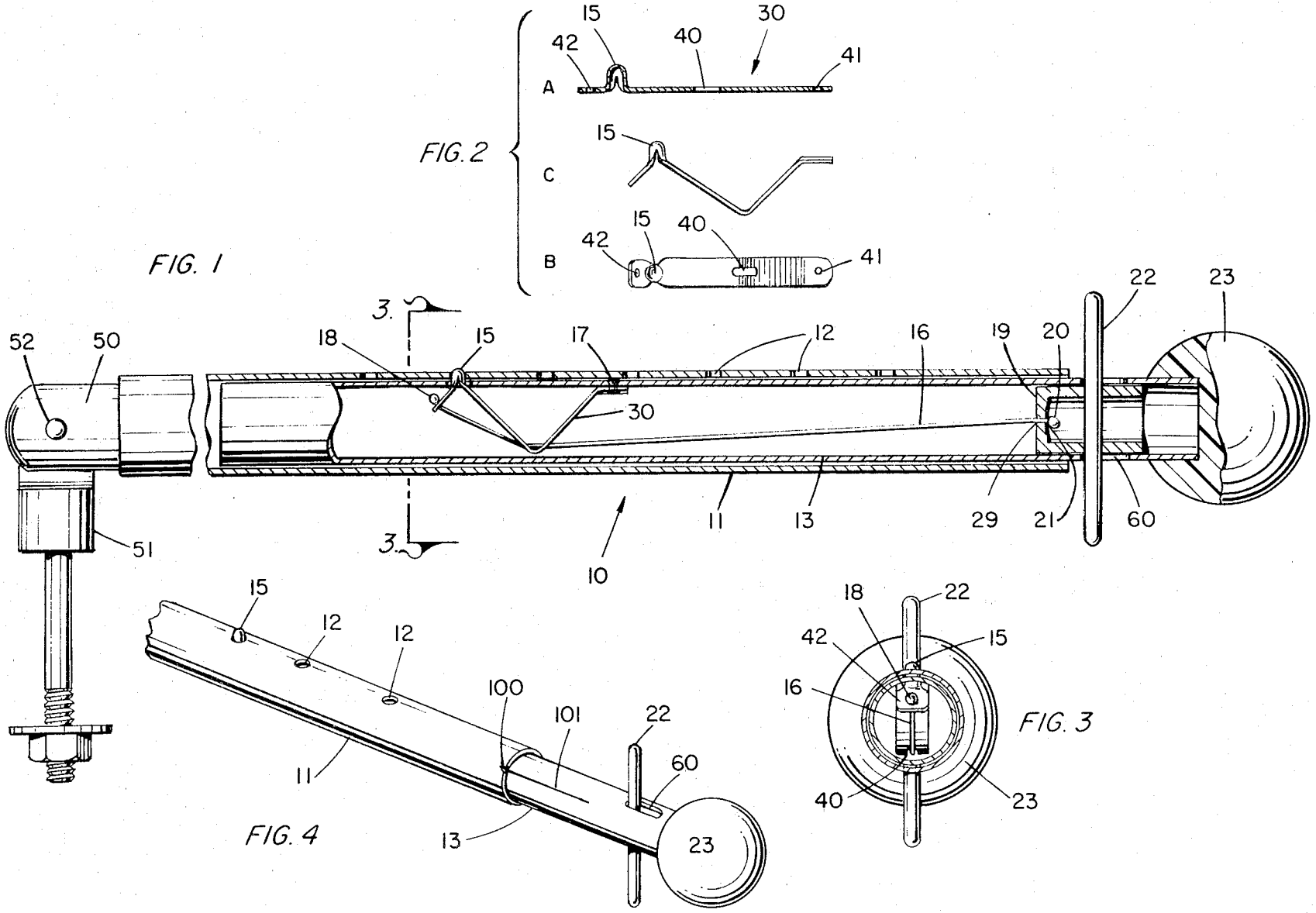
FIG. 1 is a partially broken away, partially cross-sectional view of the tiller extension of the instant invention.
FIG. 3 is a cross-sectional view of the tiller extension taken along the lines 3—3 in FIG. 1.
FIG. 4 is a perspective view of a portion of the tiller extension of the instant invention.

Referring now to FIG. 1., there is shown a longitudinal, partially broken away, partially cross-sectional view of the tiller extension 10 of the instant invention. The tiller extension 10 includes an outer tube 11 which can be fabricated of anodized aluminum, stainless steel or any other suitable material. The tube is, typically, on the order of a $\frac{3}{4}''$ in diameter. A plurality of holes 12, on the order of $\frac{1}{4}''$ in diameter, are drilled, or formed, in any suitable fashion. in tube 11. These holes are, preferably, provided in a linear alignment along substantially the entire length of tube 11.

Affixed to the closed end of tube 11 is a suitable hardware unit 50 such as a clevis. Clevis 50 can be formed as a part of the end of tube 11, swaged thereto, or in any other way joined together with the tube 11. The clevis 50 is arranged to mate with suitable hardware for mounting to the tiller, per se. This hardware 51 can include a swivel base, quick release plate, a through-bolt or the like, and is adjoined to clevis 50 by means of a rivet 52, a bolt or the like.

The inner tube 13 is fabricated of material which is essentially similar to the tube 11. The materials should be selected and fabricated so as to have sufficient structural strength to avoid breaking, bending or the like while being used.

Tube 13 is of substantially the same length as 11 and has an outer diameter of approximately $\frac{5}{8}''$ so that it moves snugly, but freely, within tube 11.

A single aperture 14 is provided adjacent the inner end of tube 13. This aperture 14 is arranged to receive locking button 15 therethrough. Button 15, as will be seen, is also adapted to selectively engage one of the apertures 12 which are formed in tube 11 to produce the locking effect.

As shown in FIG. 1, button 15 is formed of a spring loaded apparatus which can be fabricated of a single piece of spring steel or the like.

As seen in FIG. 1, one end of the spring steel apparatus 30 is joined to inner tube 13 by means of a suitable junction 17 such as a pop-rivet, a spot weld or the like. The other end of the spring apparatus 30 is connected to wire 16. In particular, a knob or other connection 18 at the end of wire 16 is joined to spring apparatus 30. The wire 16 extends through the length of tube 13 and is joined to a wire retention means 19 by means of another knob or connection means 20.

The retention cup 19 may be fabricated of a suitable material such as a plastic of a type of Delrin, nylon or the like. The retention cup in this embodiment is, basically, a cylindrical member which has a bore 28 through one end thereof and a hole 24 (or slot) at the other end which communicates with the bore 28. The wire 16 extends through the hole or slot into the bore in cup 19. The end of wire 16 is formed into a suitable enlarged device 20 such as a knot, a blob or the like which prevents the end of wire 16 from passing through the small hole in cup 19. The end of wire 16 can be joined to a suitable enlarged element, nut, or the like. In some cases, a washer 21 or the like may be used as the bearing surface for the end 20 of wire 16, as discussed hereinafter.

The cup 19 is mounted, in suitable fashion in the end of tube 12. Typically, cup 19 is permitted to slidably move within tube 13.

A cross bar or pin 22 is arranged to pass through retention cup 19 but to be joined thereto by means of a force fit, a press fit or the like. Any suitable arrangement of interconnection between pin 22 and cup 19 can be effected. Pin 22 extends through a slot 60 in tube 13 so that pin 22 and the attached cup 19 can move slidably within tube 13 as noted above. In the illustration shown in FIG. 1, the pin 22 and cup 19 slide right-to-left when activated, as described hereinafter.

A suitable knob 23 is affixed or joined to the outer end of tube 13 in any suitable fashion such as swaging, threaded engagement or the like. In practice, a round knob of a high coefficient of friction material is found to be advantageous. That is, the high coefficient of friction permits easy grasping and turning or handling of the knob. On the other hand, the knob provides a universal positioning ability for the sailor's hand as it holds the knob.

Referring now to FIG. 2A, there is shown a cross-sectional view of a spring apparatus 30 after it has been formed to include the button 15 but before it has been bent.

Referring to FIG. 2B, there is a plan view of the spring apparatus 30 showing the button 15. The spring apparatus 30 includes apertures 41 and 42 at the opposite ends thereof and an elongated slot-like aperture 40 at approximately the middle of the spring. The aperture 40 is used to trap and guide wire 16 as will become apparent hereinafter. Aperture 42 receives wire 16 and aperture 41 is used with the pop-rivet 17 (see FIG. 1).

Referring to FIG. 2C, there is shown an elevation view of the spring apparatus 30 after it has been bent into the configuration which is preferable in the instant invention.

Referring now to FIG. 3, there is shown a diametric cross sectional view of the invention. The relationship between tubes 11 and 13 and spring 30 is clear. In this case, the spring 30 is shown to engage or abut the inner surface of tube 13. The wire 16 is then trapped in the slot 40 in spring 30. It is not considered essential that the spring 30 actually touch the inner surface of tube 13 although this is a preferred embodiment.

Referring now to FIG. 4, there is shown a perspective view of a portion of the tiller extension of the instant invention. The outer tube 11 includes a plurality of apertures 12 which are arranged substantially co-linear along the periphery of the tube. In addition, the outer tube 11 includes a notch 100 which is in alignment with the apertures 12.

The inner tube 13 includes a line 101 which can be scribed, painted or in any other suitable fashion affixed to the surface of inner tube 13. This line is arranged to be related to, for example co-linear with, the center line of button 15 which is mounted in tube 13 in the fashion described above. Thus, when the tube 13 is moved relative to tube 11, the operator need only align the index line 101 with the notch 100 to assure that the button 15 is aligned with the apertures 12. This will be of great assistance to an operator who is working under stressful conditions such as sailing and manipulating in a small sailing vessel.

In operation, the tiller extension 10 of the instant invention is joined to the tiller part of the sailboat in a shown and described relative to the Forespar tiller extension noted above. The outer tube 11 is then, essentially, fixed to the tiller. The inner tube is then movable relative to the outer tube 11. The button 15 is, selectively, spring loaded outwardly through aperture 14 in tube 13 and an aligned aperture 12 in tube 11. The button 15 is arranged to provide a secure locking between these two tubes so that relative motion thereof cannot be produced when the button 15 is in the engaged position.

In order to selectively remove button 15 from this locking arrangement, the operator, without removing his (or her) hand from knob 23, will merely reach down with one or more fingers, grasp pin 22 and pull thereon toward knob 23. As pin 22 is moved in slot 60, the retention cup 19 also moves which, of course, pulls on wire 16 which is connected at the unrestrained end of spring 30. With the configuration of spring 30, the pressure applied by wire 16 causes the spring 30 to deform (i.e. bend) wherein button 15 is removed from aperture 12. Preferably, the spring is configured so that button 15 is not removed from aperture 14 although this would not be a problem because spring 30 is affixed in proper position so that the button 15 would automatically be realigned with aperture 14.

The sailor need only then continue to pull on pin 22 and/or knob 23 to reposition the inner tube 13 relative to the outer tube 11. As the inner tube is moved, the scribe line 101 is maintained in alignment with notch 100 and the pressure applied to spring 22 is released by the sailor when the tiller extension is at approximately the appropriate length. The release of pin 22 permits the spring 30 to assume its normal position wherein button 15 is forced outwardly relative to the tube. When the button 15 is in alignment with an aperture 12, the button and aperture are then engaged and interlocked and the tiller extension is now locked in the selected position 12.

Inasmuch as this position is where the sailor wished to have the tiller extension, in terms of length, the system is advantageously and desirably located.

Of course, as soon as the sailor wishes to relocate the tiller extension, the same operation can be utilized and the tiller can be extended or shortened as necessary and/or desirable. It is seen that this arrangement permits a one-hand operation with virtually no distraction from other sailing manipulations. The scribe and notch permits the user to make the proper alignment very easily and readily so that lost motion can be avoided.

While the system does not have an infinite number of adjustments, the number and degree of positions can be controlled by means of the spacing between apertures 12. For example, spacing the apertures 12 by a distance of approximately 2" would give a 2" adjustment capability to the system. Of course, if other adjustment capabilities are required, the apertures can be positioned accordingly.

Thus, there is shown and described a tiller extension apparatus which includes a telescoping, tubular arrangement and a quick and easy release of a positive locking apparatus. The description is pointed out in certain specific embodiments and examples. However, other embodiments and/or examples can be readily determined by those skilled in the art. For example, the linkage can be arranged to push on the spring loaded button or the spring configuration can be altered. However, any such modifications which fall within the purview of this description are intended to be included therein as well. This description is intended to be illustrative only and is not intended to be limitative. Rather, the scope of the invention is limited only by the claims appended hereto.

Having thus described a preferred embodiment of the instant invention, what is claimed is:

1. An extendable apparatus comprising, an outer tube (11), an inner tube (13) movably mounted within the outer tube, said inner and outer tubes being free to slide relative to each other, said outer tube having a plurality of co-linear apertures (12) therethrough, said outer tube has a first indicia (100) at at least one end thereof aligned with said co-linear apertures, spring loaded button means (15) mounted within said inner tube and adapted to extend therefrom and to engage one of said apertures in said outer tube, said inner tube has a second indicia (101) theron aligned with said button means whereby said first and second indicia can be aligned with each other in order to align said button means with said apertures, linkage apparatus (16,18,20) connected to said spring loaded button means in order to selectively cause said button to be withdrawn from engagement with any of said apertures, said linkage apparatus comprises elongated wire means (16), retainer means (19) slidably mounted within said inner tube and connected to selectively operate said linkage apparatus, said retainer means comprises a sleeve member (19) adapted to retain one end (20) of said linkage apparatus therein, and gripping means (23) attached to an exposed end of said inner tube which extends beyond said outer tube.

2. The apparatus recited in claim 1 wherein, said gripping means comprise a spherical handle.

3. The apparatus recited in claim 2 wherein, said spherical handle is formed of a high coefficient of friction material for easy gripping thereof.

4. The apparatus recited in claim 1 wherein, said first indicia comprises a notch in the end of said outer tube, and said second indicia comprises a line on said inner tube.

5. The apparatus recited in claim 1 wherein, said retainer means includes pin means whereby force can be applied thereto in order to move said retainer and said linkage means.

6. The apparatus recited in claim 5 wherein, said inner tube includes apertures (60) therein for slidably receiving said pin means in said retainer means.

7. An adjustable tiller arm extension apparatus comprising, an outer tube, an inner tube movably mounted within the outer tube and having one end thereof which extends beyond said outer tube, said outer tube having a plurality of co-linear apertures therethrough, spring loaded locking means mounted within said inner tube and adapted to extend therefrom and to engage one of said apertures in said outer tube, linkage apparatus comprising an elongated wire means connected to said spring loaded locking means in order to selectively cause said locking means to be withdrawn from engagement with any of said apertures, retainer means movably mounted within said inner tube and connected to said wire means to selectively operate said locking means by applying force to said linkage apparatus, and said retainer means comprises a sleeve member adapted to retain one end of said wire means of said linkage apparatus therein, said retainer means includes pin means therein whereby force can be applied thereto in order to move said retainer and said linkage apparatus, said outer tube includes apertures therein for slidably receiving said pin means in said retainer means, and spherical gripping means formed of a high coefficient of friction material attached to said one end of said inner tube adjacent said retainer means.

8. The apparatus recited in claim 7 wherein, said outer tube has a first indicia at one end thereof and aligned relative to said co-linear apertures, said inner tube has a second indicia thereon aligned relative to said locking means whereby said first and second indicia can be aligned with each other to align said locking means with said apertures.

9. The apparatus recited in claim 8 wherein, said first indicia comprises a notch in the end of said outer tube, and said second indicia comprises a line at the surface of said inner tube.

* * * * *